US012234056B2

(12) United States Patent
Benito Huertas et al.

(10) Patent No.: US 12,234,056 B2
(45) Date of Patent: Feb. 25, 2025

(54) ADAPTIVE STORAGE RACK

(71) Applicant: SAINT-GOBAIN GLASS FRANCE, Courbevoie (FR)

(72) Inventors: Francisco José Benito Huertas, L'Arboç Tarragona (ES); Alberto Martinez De Pablo, Cubellas Barcelona (ES)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 474 days.

(21) Appl. No.: 17/442,973

(22) PCT Filed: Mar. 25, 2020

(86) PCT No.: PCT/EP2020/058269
§ 371 (c)(1),
(2) Date: Sep. 24, 2021

(87) PCT Pub. No.: WO2020/193596
PCT Pub. Date: Oct. 1, 2020

(65) Prior Publication Data

US 2022/0194656 A1 Jun. 23, 2022

(30) Foreign Application Priority Data

Mar. 27, 2019 (FR) ..... 1903200

(51) Int. Cl.
*B65D 19/44* (2006.01)
*B65D 85/48* (2006.01)

(52) U.S. Cl.
CPC ..... *B65D 19/44* (2013.01); *B65D 85/48* (2013.01); *B65D 2519/00273* (2013.01);
(Continued)

(58) Field of Classification Search
CPC ..... B65D 2519/00164; B65D 2519/00532; B65D 85/48; B65D 19/44; B65D 2519/00059
(Continued)

(56) References Cited

U.S. PATENT DOCUMENTS 2,699,911 A * 1/1955 Chase ..... B65D 19/385 108/53.5
2,801,752 A * 8/1957 Jakubowski ..... A47B 81/005 211/49.1
(Continued)

FOREIGN PATENT DOCUMENTS

DE 79 23 656 U1 7/1981
DE 20 2008 010072 U1 11/2008
(Continued)

OTHER PUBLICATIONS

KR International Search Report as issued in International Patent Application No. PCT/EP2020/058269, dated May 11, 2020.
(Continued)

*Primary Examiner* — Steven A. Reynolds
*Assistant Examiner* — Prince Pal
(74) *Attorney, Agent, or Firm* — Pillsbury Winthrop Shaw Pittman LLP

(57) ABSTRACT

A rack for storing and/or transporting elements, in particular glazing elements, of the type including a receiving structure for these elements, the top part of the structure including a receiving device and a securing device for an additional top rack that is to be stacked thereon, and the bottom part of this structure including a complementary device that can allow it to cooperate with the receiving device and the securing device of an additional bottom rack on which it is to be stacked. The securing device includes at least two members separated from one another in the transverse direction by a
(Continued)

Figure 1:
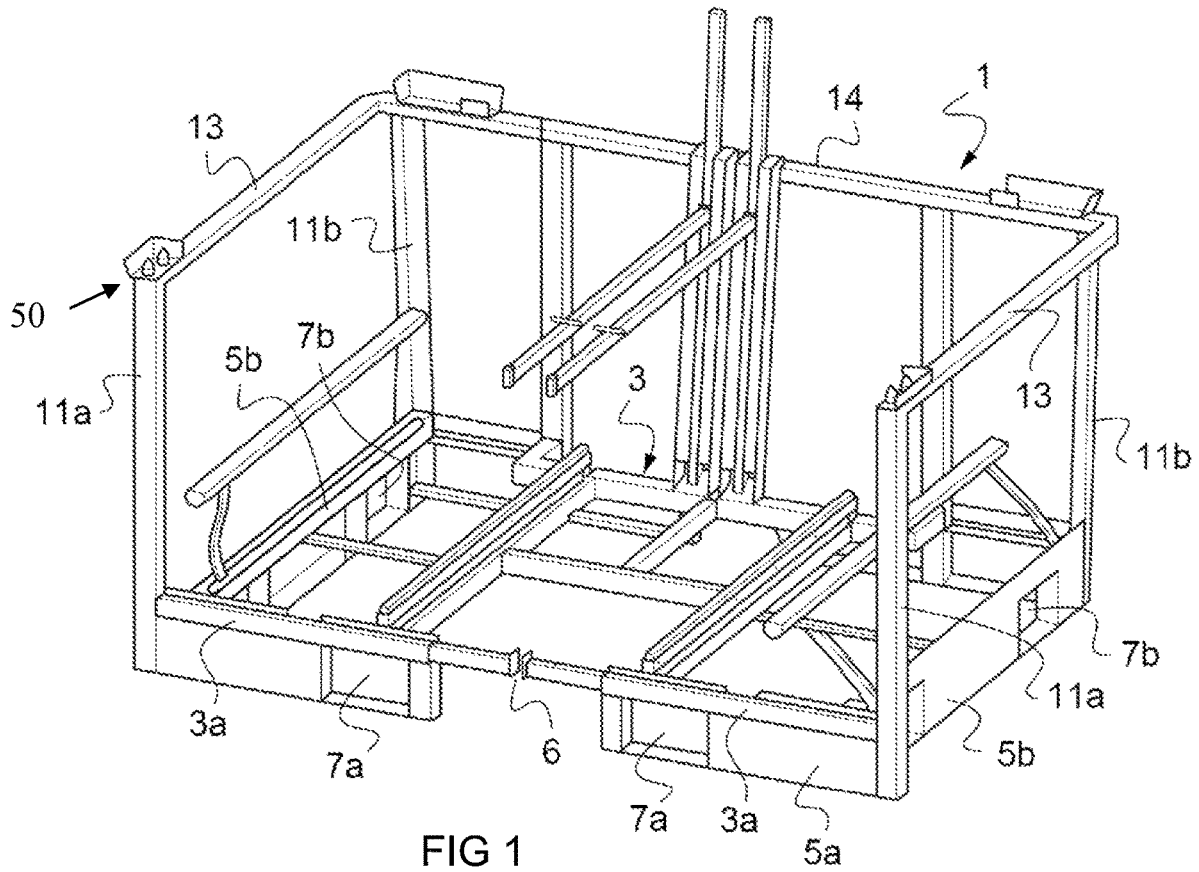

value of a pitch corresponding to a difference in dimensions, in the transverse direction, of the racks that are to be stacked.

20 Claims, 5 Drawing Sheets

(52) U.S. Cl.
CPC ..... *B65D 2519/00293* (2013.01); *B65D 2519/00323* (2013.01); *B65D 2519/00333* (2013.01); *B65D 2519/00502* (2013.01); *B65D 2519/00532* (2013.01); *B65D 2519/00562* (2013.01); *B65D 2519/00815* (2013.01); *B65D 2519/0097* (2013.01)

(58) Field of Classification Search
USPC ..... 206/386, 599, 600, 511, 509; 108/55.1, 108/53.1; 211/194, 190, 191
See application file for complete search history.

(56) References Cited

U.S. PATENT DOCUMENTS 3,147,860 A * 9/1964 Kean, Sr. ..... B65G 49/062 108/53.5
3,391,797 A * 7/1968 Baldwin ..... A47B 47/03 108/107
3,499,398 A * 3/1970 Murray ..... B65D 19/385 108/53.5
3,533,502 A * 10/1970 Hansen ..... A47B 45/00 206/386
3,809,234 A * 5/1974 Kurick ..... B65D 85/48 206/451
3,857,494 A * 12/1974 Giardini ..... A47B 47/05 108/53.5
3,938,660 A * 2/1976 Moehring ..... B65D 19/08 206/451
3,945,501 A * 3/1976 Jay ..... B65D 61/00 108/53.5
3,982,638 A * 9/1976 Lamson ..... A47B 87/0215 206/386
3,995,738 A * 12/1976 Rowley ..... B65D 85/48 206/451
4,086,263 A * 4/1978 Rowley ..... B65D 85/48 410/35
4,186,841 A * 2/1980 Buckley ..... B65D 19/12 220/4.28
4,199,069 A * 4/1980 Talarico ..... B65D 19/08 108/53.5
4,261,470 A * 4/1981 Dolan ..... F16B 7/22 403/237
4,653,652 A * 3/1987 Avati ..... F16B 7/0446 211/189
4,773,547 A * 9/1988 Bell ..... B65G 1/02 108/53.1
4,871,075 A * 10/1989 Moulds ..... B65D 19/44 206/448
4,899,891 A * 2/1990 Sipila ..... B65G 49/062 206/448
4,921,101 A * 5/1990 Gatt ..... B65D 85/48 206/451
4,934,538 A * 6/1990 Beyer ..... B65G 49/062 211/49.1
5,012,938 A * 5/1991 King ..... A47B 57/18 211/182
5,101,976 A * 4/1992 Salisbury ..... B65D 85/48 206/453
5,145,073 A * 9/1992 Kitagawa ..... B65D 85/48 211/49.1
5,154,310 A * 10/1992 Massey ..... B65D 19/44 206/505
5,228,821 A * 7/1993 Gleffe ..... B65D 19/12 211/195
5,507,237 A * 4/1996 Barrow ..... B66C 1/16 108/55.3
5,533,456 A * 7/1996 Regina ..... B65D 19/385 211/183
5,582,495 A * 12/1996 Schroeder ..... B61D 45/006 410/43
5,845,794 A * 12/1998 Highsmith ..... A47F 5/13 211/151
5,890,612 A * 4/1999 Coppi ..... B65D 88/14 220/531
6,044,990 A * 4/2000 Palmeri ..... A47B 47/0016 403/231
6,227,397 B1 * 5/2001 Kim ..... B65D 88/121 220/8
6,279,763 B1 * 8/2001 Bush ..... B65D 88/522 211/85.5
6,332,549 B1 * 12/2001 MacDonald ..... A47B 47/027 211/183
6,464,092 B1 * 10/2002 Kortman ..... A47B 46/00 211/162
6,705,466 B2 * 3/2004 Bartholomew ..... B65D 85/48 206/451
7,008,719 B2 * 3/2006 Zaffino ..... H01M 50/262 429/49
7,152,749 B2 * 12/2006 Beck ..... B65D 19/44 206/335
7,270,236 B2 * 9/2007 Angeletti ..... B65G 49/062 211/195
7,328,804 B2 * 2/2008 Andre ..... B65D 19/44 206/443
D603,123 S * 10/2009 Canters ..... D34/38
7,802,526 B2 * 9/2010 Brady ..... B65D 19/12 108/53.5
7,905,183 B2 * 3/2011 Gibson ..... B65D 19/385 206/386
7,997,441 B2 * 8/2011 Marcel ..... B65D 88/128 206/386
8,210,374 B2 * 7/2012 Harpole ..... B65D 19/12 211/195
8,261,921 B2 * 9/2012 Anscomb ..... B65D 19/08 211/175
8,297,450 B2 * 10/2012 Zavidniak ..... H05K 7/183 211/13.1
9,394,100 B2 * 7/2016 Glover ..... B65D 19/06
9,493,295 B2 * 11/2016 Glover ..... B65G 49/062
10,407,209 B1 * 9/2019 Choi ..... B65D 19/12
10,773,920 B2 * 9/2020 Crozier ..... B65H 75/04
11,690,446 B2 * 7/2023 Harrison ..... A47B 47/021 211/153
2002/0008048 A1 * 1/2002 Ishikawa ..... B65D 19/385 206/600
2002/0043509 A1 * 4/2002 Lajeunesse ..... A47F 1/087 211/74
2002/0182035 A1 * 12/2002 Karlen ..... B63B 25/22 108/55.3
2003/0155319 A1 * 8/2003 Wishart ..... A47F 5/101 211/187
2004/0168946 A1 * 9/2004 Angeletti ..... B65G 49/062 206/386
2005/0103736 A1 * 5/2005 Calleja ..... A47B 47/021 211/187
2006/0037924 A1 * 2/2006 Palmisano ..... A47B 87/0246 211/194
2006/0138066 A1 * 6/2006 Hung ..... A47F 5/10 211/189
2007/0215568 A1 * 9/2007 Heinrichs ..... B65D 88/522 211/191
2008/0006596 A1 * 1/2008 Palmeri ..... A47B 47/005 211/189
2008/0173597 A1 * 7/2008 Shiffet ..... A47B 47/027 211/206
2008/0237168 A1 * 10/2008 Harpole ..... B65D 19/12 211/195
2009/0272666 A1 * 11/2009 Marcel ..... B65D 90/0033 206/386

(56) References Cited

U.S. PATENT DOCUMENTS

| | | | | |
|---|---|---|---|---|
| 2010/0288664 | A1* | 11/2010 | Glover | B65D 85/48 206/386 |
| 2011/0220544 | A1* | 9/2011 | De Alba | B65D 19/385 220/4.28 |
| 2014/0076761 | A1* | 3/2014 | Hellweg | B65G 1/02 206/386 |
| 2015/0257530 | A1* | 9/2015 | Naka | A47B 47/005 211/188 |
| 2022/0169418 | A1* | 6/2022 | Benito Huertas | B65D 19/44 |
| 2022/0194656 | A1* | 6/2022 | Benito Huertas | B65D 85/48 |
| 2023/0064354 | A1* | 3/2023 | Ledford | E04G 5/004 |
| 2023/0294871 | A1* | 9/2023 | Leven | B65D 19/44 206/386 |

FOREIGN PATENT DOCUMENTS

| | | | |
|---|---|---|---|
| JP | H06-191580 | A | 7/1994 |
| JP | 2004-142795 | A | 5/2004 |
| JP | 2007-045470 | A | 2/2007 |
| JP | 2010-058799 | A | 3/2010 |
| JP | 2012-062132 | A | 3/2012 |
| KR | 10-1640245 | B1 | 7/2016 |
| WO | WO 00/37324 | A1 | 6/2000 |

OTHER PUBLICATIONS

First Office Action as issued in Korean Patent Application No. 10-2021-7033134, dated Oct. 7, 2024.

First Office Action as issued in Japanese Patent Application No. 2021-556547, dated Oct. 10, 2023.

* cited by examiner

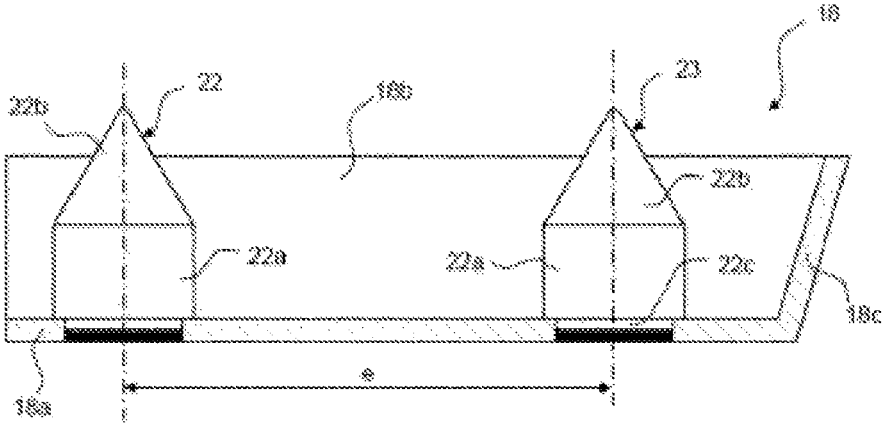
FIG 3
FIG 3a
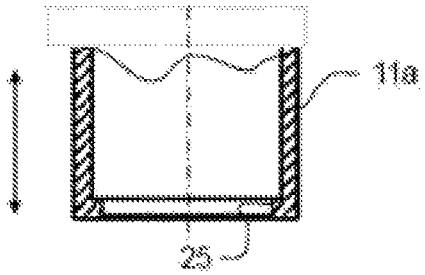
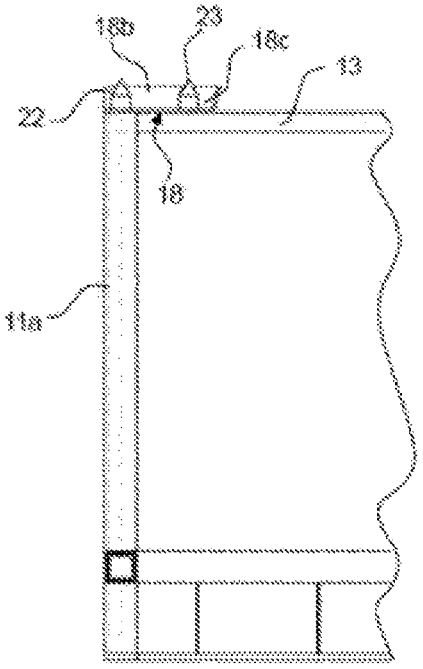
FIG 4

[Fig. 5]
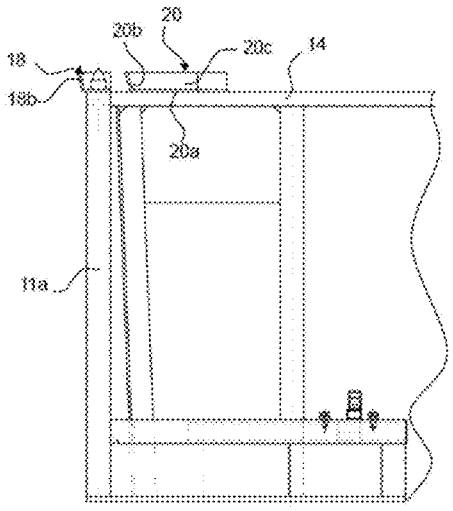
[Fig. 6]
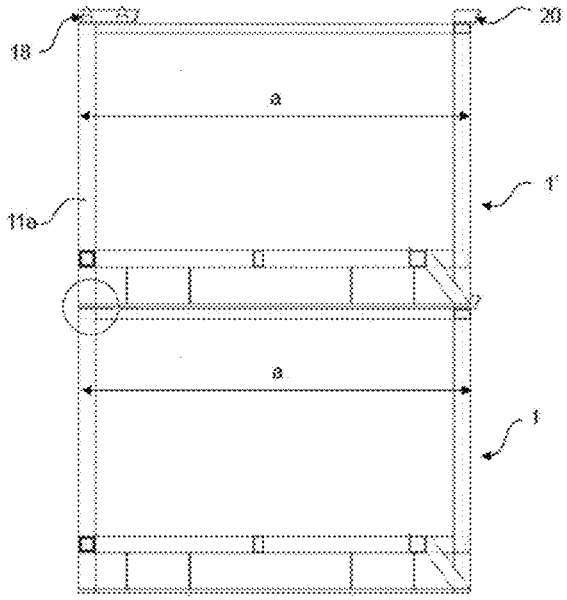

[Fig. 7]
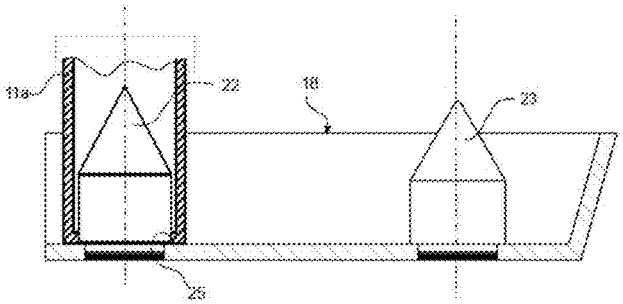
[Fig. 8]
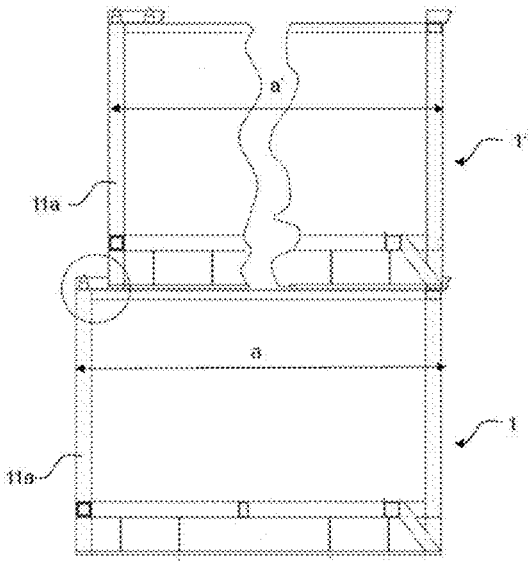

[Fig. 9]
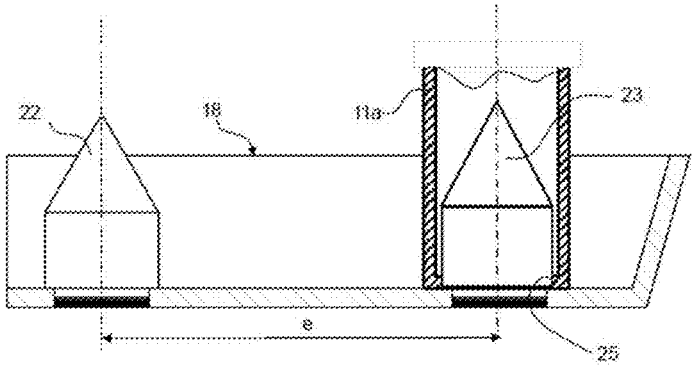
[Fig. 10]
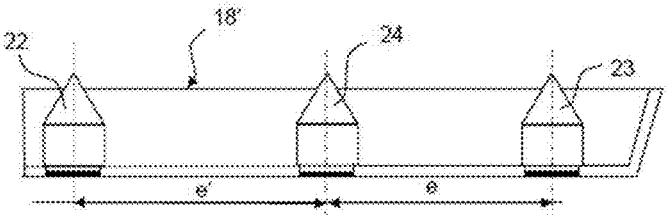

ADAPTIVE STORAGE RACK

CROSS-REFERENCE TO RELATED APPLICATIONS

This application is the U.S. National Stage of PCT/EP2020/058269, filed Mar. 25, 2020, which in turn claims priority to French patent application number 1903200 filed Mar. 27, 2019. The content of these applications are incorporated herein by reference in their entireties.

The present invention relates to a rack intended for the storage and/or the transportation of glazing elements, in particular glazing units intended for automobiles, such as, for example, windshields, back windows or sidelites.

It is known that the racks of this type generally consist of mechanically welded tubular elements which form a receiving cradle on which the glazing elements are deposited in such a way that they rest on their rim, parallel to one another.

Such racks usually have standard dimensions and occupy a ground surface area that is substantially rectangular, the glazing elements being distributed in the longitudinal direction. Furthermore, these racks can be stacked and, to this end, comprise receiving means whose purpose is to ensure an accurate positioning on one another, and securing means ensuring that they are linked both in the longitudinal direction and in the transverse direction once they are stacked.

These securing means usually consist of a cylindrical block ending with a cone, which is disposed in the top part of the rack of each side thereof and orifices provided at its base which are situated in line with these blocks. Thus, when two racks of identical dimensions are superposed, the two blocks of the bottom rack are housed in the respective orifices of the top rack.

It is understood in these conditions that it is possible to superpose only racks whose base surface area is strictly identical.

A difficulty arises when wanting to fill transport vehicles with such racks, whether these vehicles are road or rail vehicles, insofar as the receiving surface areas are not always a multiple of the base dimensions of the racks. More often than not that is not the case and the volume that is thus not used represents for the user a significant loss.

The present invention aims to allow the user to come close to optimally filling the chosen transportation means while increasing the quantity of elements transported compared to that which usually exists with the known standard racks.

Thus, the subject matter of the present invention is a rack for storing and/or transporting elements, in particular glazing elements, of the type comprising a receiving structure for these elements, the top part of the structure comprising receiving means and securing means for an additional top rack that is to be stacked thereon, and the bottom part of this structure comprising complementary means that can allow it to cooperate with the receiving means and the securing means of an additional bottom rack on which it is to be stacked.

This rack is characterized in that the securing means comprise at least two members separated from one another in the transverse direction by a value corresponding to a difference in dimensions, in the transverse direction, of the racks that are to be stacked.

Preferentially, the securing means will be able to comprise two members. These members will be able to consist of dog points and the complementary means will be able to consist of an orifice produced in the anterior base of the structure.

The dog points will be able to comprise a cylindrical base topped by a conical part.

Figure 2:
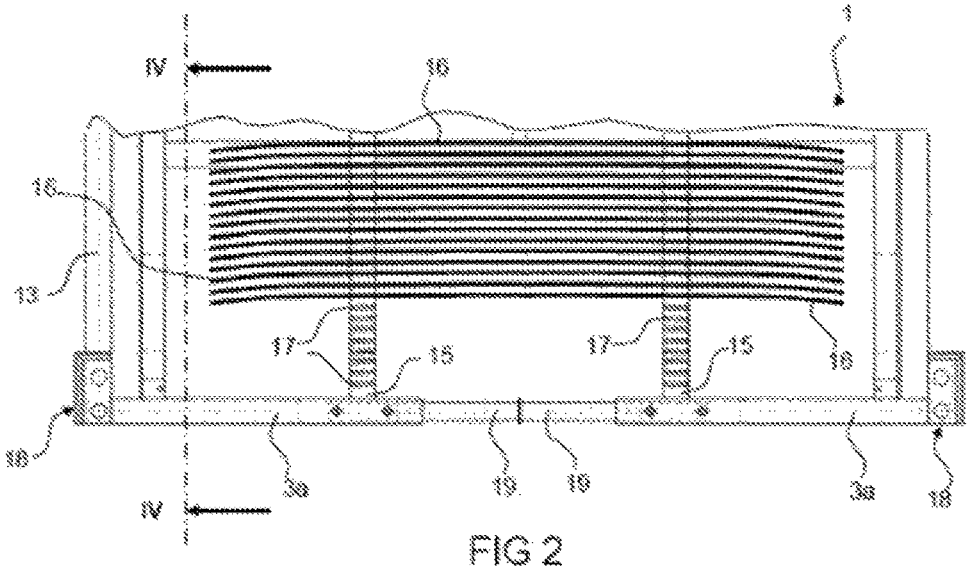

Embodiments of the present invention will be described hereinbelow as nonlimiting examples with reference to the attached drawing in which:

FIG. 1 is a perspective view of a rack provided with receiving means and securing means according to the invention, FIG. 2 is a partial top view of the rack represented in FIG. 1, FIG. 3 is an enlarged view in transverse cross section of the receiving means and of the securing means of the rack according to the invention, FIG. 3*a* is a view in vertical cross section of the base of an anterior vertical upright of the rack according to the invention, FIG. 4 is a view in partial vertical cross section of the rack along the line IV-IV of FIG. 2, FIG. 5 is a partial front view of the rack represented in FIGS. 1 and 2, FIG. 6 is a view in partial cross section along the line IV-IV of FIG. 2 of a stack of two racks of identical transverse dimensions, FIG. 7 is an enlarged partial schematic view of the encircled part of FIG. 6, FIG. 8 is a view in partial cross section along the line IV-IV of FIG. 2 of a stack of two racks of different transverse dimensions, FIG. 9 is an enlarged partial schematic view of the encircled part of FIG. 8, FIG. 10 is a view in transverse cross section of a variant embodiment of the receiving and securing means of the rack according to the invention.

Throughout the description, the rack 1 according to the invention is considered to rest on a support, ready to be loaded/unloaded, which makes it possible to define its "bottom" and "top" parts. The aperture for access to the glazing elements is inscribed in a longitudinal plane, and is positioned on the anterior part of the rack 1, that is to say in proximity to an operator required to load/unload the glazing elements. By contrast, the posterior part of the rack 1 is the part furthest away from the operator. The glazing elements are therefore loaded from the posterior part of the rack 1 to the anterior part of the rack 1, in a transverse direction, and are oriented, for each of them, in a substantially longitudinal direction. The expressions "bottom", "top", "anterior", "posterior", longitudinal" and "transverse" should thus be considered relative to this orientation.

The rack 1 according to the invention which, in the present implementation, is made of mechanically welded tubes, comprises a frame 3 whose base is of substantially rectangular form and whose anterior face is provided with a toeboard 5*a* which is slightly wider than the frame 3 and whose lateral faces are provided with a toeboard 5*b*.

The toeboards 5*a* and 5*b* are respectively pierced with two apertures 7*a* and 7*b* which are intended to allow the passage of the arms of a lifting operator of pallet truck type. The part of the anterior toeboard 5*a* and the anterior part 3*a* of the frame 3 situated between the two apertures 7*a* are interrupted so as to create a controlled access space 6 opening onto the interior of the rack 1.

The two ends of the anterior toeboard 5*a* end with anterior vertical uprights 11*a* whose tops are respectively joined by crossmembers 13 to the tops of two vertical uprights 11*b* standing at the posterior corners of the frame. Moreover, the tops of the two posterior vertical uprights 11*b* are joined to one another by a crossmember 14, oriented in a transverse direction.

The base frame 3 is provided with two transverse uprights 15, the top face of which is provided over all its length with notches 17 which are intended to receive the rims of the glazing elements 16 in a longitudinal direction, in particular the windshields or the back windows of vehicles, which are intended to be stored/transported, so as to hold them in a substantially vertical position.

The controlled access space 6 of the rack 1 comprises means which make it possible to close it off during transportation or storage, which makes it possible to ensure the protection of the glazing elements 16, and which also make it possible to free it up during the loading/unloading operation, which improves the access to the glazing elements, in particular those which are stored in the posterior part of the rack, that is to say away from the operator.

The racks according to the invention are intended to be stacked one on top of the other and, for this, comprise, on the one hand, receiving means, or guiding means, that can promote the implementation of this superpositioning and securing means that can prevent the movement of the racks once the latter are in place. FIG. 1 shows securing means 50.

As represented in FIGS. 4 and 5, the receiving means consist of two anterior guides 18 and of two posterior guides 20.

Each anterior guide 18, which is disposed on the anterior part of the crossmember 13, comprises a base 18*a* provided with two wings which are inclined from top to bottom and from the outside to the inside of the guide, namely a wing 18*b* of transverse direction and a wing 18*c* of longitudinal direction. The inclination of these wings confers upon them a deflector function that makes it possible, when one rack is being stacked on another, to push back the rack to be positioned when it is not perfectly centered relative to the receiving rack in order to deflect it and bring it into the correct position, as explained hereinbelow.

Likewise, each posterior guide 20 which is disposed on the posterior crossmember 14 comprises a base 20*a* provided with two wings which are inclined from top to bottom and from the outside to the inside of the guide, namely a wing 20*b* of transverse direction and a wing 20*c* of longitudinal direction.

The securing means which are disposed in the anterior guides 18 comprise, as represented in FIGS. 3, 7 and 9, two dog points, namely an anterior dog point 22 and a posterior dog point 23, aligned in a transverse direction. These dog points comprise a cylindrical base 22*a* topped by a cone 22*b*. The base 22*a* is provided with a bottom boss 22*c* which comes to be embedded in a hole of the base 18*a* of the guide with which it is welded.

The dog points 22 and 23 have a diameter such that they can be introduced into holes 25 provided at the bottom end of the anterior vertical uprights 11*a*, as represented in FIG. 3*a*.

FIG. 6 shows a stack of two identical racks whose width a, or transverse dimension, is greater than that a' of the standard racks of the prior art, namely a bottom rack 1 on which there is disposed a top rack 1', a disposition which thus makes it possible to very substantially increase the number of elements transported. In such an implementation of the invention and as represented in FIG. 7, the anterior dog point 22 of the guide 18 of the bottom rack 1 fits into the hole 25 of the base of the anterior vertical upright 11*a* of the top rack 1'.

FIGS. 8 and 9 show a stack of two racks of different transverse dimensions, namely a bottom rack 1 of width a on which there is disposed a top rack 1' of smaller width a' corresponding to that of the racks of the prior art. In this disposition and as represented in FIG. 9, the posterior dog point 23 of the guide 18 of the bottom rack fits into the hole 25 of the base of the anterior vertical upright 11*a* of the top rack.

The present invention is particularly advantageous in that it makes it possible to stack not only identical racks as represented in FIGS. 6 and 7, but racks of different transverse dimensions as represented in FIGS. 8 and 9.

The present invention thus allows the user, based on the surface area available in the transport vehicle, to combine racks of conventional type of width a' with racks of greater width a so as to occupy all of the available space. It is understood that the separation e that will be produced between the dog points 22 and 23 will correspond to the difference that exists between the transverse dimensions a and a' of the racks 1 and 1'.

Obviously, according to the invention, the guides can comprise a greater number of pins. Thus, in FIG. 10, the anterior guide 18' comprises three dog points, namely an anterior dog point 22, an intermediate dog point 24 and a posterior dog point 23, all three aligned in a transverse direction. The distance separating two adjacent dog points can be different, as represented in FIG. 10 in which the anterior 22 and intermediate 24 dog points are separated by a length e' and the intermediate 24 and posterior 23 dog points are separated by a greater distance e.

Such a disposition makes it possible to further increase the combinations of arrangement available to the user in order to allow him or her to produce an optimal loading of the means for transporting his or her racks.

Finally, it is known that the number of racks that the transport vehicle can transport may be limited by the weight thereof.

Now, it is understood that the weight of the racks can vary as a function of the glazing elements that are to be transported. The present invention, by allowing racks of different dimensions, and therefore of different weights, to be combined, allows the carrier to best adjust the total weight of the racks disposed in the transport vehicle with the weight capacity thereof.

The invention claimed is:

1. A rack for storing and/or transporting elements comprising a structure receiving the elements, a top part of the structure comprising receiving means and securing means for an additional top rack to be stacked on said rack for storing and/or transporting elements, and a bottom part of the structure comprising complementary means that can allow it to cooperate with the receiving means and the securing means of a bottom rack on which it is to be stacked, wherein the securing means comprise at least two members separated from one another in a transverse direction by a value corresponding to a difference in dimensions, in the transverse direction, of the racks that are to be stacked, wherein the structure comprises a first and a second vertical upright that each form a corner of the structure, and a first crossmember connected to an upper portion of the first vertical upright and an upper portion of the second vertical upright so that the first and second vertical uprights are joined together via the first crossmember, wherein at least one of the at least two members is arranged at a top of the first crossmember at a position between the first vertical upright and the second vertical upright and wherein the at least two members are provided closer to the first vertical upright than to the second vertical upright.

2. The storage and/or transportation rack as claimed in claim 1, wherein a number of said members of the securing means is equal to two.

3. The storage and/or transportation rack as claimed in claim 1, wherein the two members consist of dog points and the complementary means consist of an orifice produced in the anterior base of the structure.

4. The storage and/or transportation rack as claimed in claim 3, wherein the dog points comprise a cylindrical base topped by a conical part.

5. The storage and/or transportation rack as claimed in claim 1, wherein at least one of said receiving means comprises a base provided with two wings which are inclined from top to bottom and from outside to inside.

6. The storage and/or transportation rack as claimed in claim 1, wherein the elements are glazing elements.

7. The storage and/or transportation rack as claimed in claim 5, wherein the two wings include a wing of transverse direction and a wing of longitudinal direction.

8. The storage and/or transportation rack as claimed in claim 1, wherein another one of the at least two members is arranged at a top of a first vertical upright.

9. The storage and/or transportation rack as claimed in claim 8, wherein the first vertical upright forms a corner of a front portion of the structure through which the elements are received for storage and the second vertical upright forms a corner of a rear portion of the structure.

10. The storage and/or transportation rack as claimed in claim 8, wherein the receiving means comprise one or more guides configured to guide a first vertical upright of the top rack to engage one of the at least two members.

11. The storage and/or transportation rack as claimed in claim 10, wherein at least a portion of the one or more guides is arranged at a top of the first crossmember and extends at least in part around the at least two members.

12. The storage and/or transportation rack as claimed in claim 11, wherein the one or more guides are inclined wings.

13. The storage and/or transportation rack as claimed in claim 8, wherein said other one of the at least two members that is arranged at the top of the first vertical upright is configured to engage a first vertical upright of a first top rack, the first vertical upright of the first top rack forming a corner of the first top rack and the first top rack having same dimensions as the rack, and wherein said at least one of the at least two members that is arranged at the top of the first crossmember at the position between the first vertical upright and the second vertical upright is configured to engage a first vertical upright of a second top rack, the first vertical upright of the second top rack forming a corner of the second top rack and the second top rack having smaller dimensions than the rack.

14. The storage and/or transportation rack as claimed in claim 8, wherein:

the structure comprises a third and a fourth vertical upright that each form a corner of the structure, and a second and a third crossmember, the second crossmember is connected to the upper portion of the second vertical upright and an upper portion of the third vertical upright so that the second and third vertical uprights are joined together via the second crossmember, the third crossmember is connected to the upper portion of the third vertical upright and an upper portion of the fourth vertical upright so that the third and fourth vertical uprights are joined together via the third crossmember, and the securing means comprise two additional members, wherein a first of the two additional members is arranged at a top of the fourth vertical upright and a second of the two additional members is arranged at a top of the third crossmember at a position between the fourth vertical upright and the third vertical upright.

15. A rack for storing and/or transporting elements comprising a structure receiving the elements, a top part of the structure comprising receiving means and securing means for an additional top rack to be stacked on said rack for storing and/or transporting elements, and a bottom part of the structure comprising complementary means that can allow it to cooperate with the receiving means and the securing means of a bottom rack on which it is to be stacked, wherein the securing means comprise at least two members separated from one another in a transverse direction by a value corresponding to a difference in dimensions, in the transverse direction, of the racks that are to be stacked, wherein the structure comprises a first and a second vertical upright that each form a corner of the structure, and a first crossmember connected to an upper portion of the first vertical upright and an upper portion of the second vertical upright so that the first and second vertical uprights are joined together via the first crossmember, wherein a first of the at least two members is arranged at a top of a first vertical upright and a second of the at least two members is arranged at a top of the first crossmember at a position between the first vertical upright and the second vertical upright.

16. The storage and/or transportation rack as claimed in claim 15, wherein a number of said members of the securing means is equal to two.

17. The storage and/or transportation rack as claimed in claim 15, wherein the two members consist of dog points and the complementary means consist of an orifice produced in the anterior base of the structure.

18. The storage and/or transportation rack as claimed in claim 17, wherein the dog points comprise a cylindrical base topped by a conical part.

19. The storage and/or transportation rack as claimed in claim 15, wherein at least one of said receiving means comprises a base provided with two wings which are inclined from top to bottom and from outside to inside.

20. The storage and/or transportation rack as claimed in claim 15, wherein the elements are glazing elements.

* * * * *